US007357740B2

(12) United States Patent
Pencer

(10) Patent No.: US 7,357,740 B2
(45) Date of Patent: Apr. 15, 2008

(54) HOCKEY TRAINING PUCKS AND METHODS OF USING SAME

(76) Inventor: Glenn Pencer, 9041 Hayward Place, Delta, British Columbia (CA) V4C 7L5

( * ) Notice: Subject to any disclaimer, the term of this patent is extended or adjusted under 35 U.S.C. 154(b) by 47 days.

(21) Appl. No.: 10/786,586

(22) Filed: Feb. 24, 2004

(65) Prior Publication Data

US 2004/0235594 A1 Nov. 25, 2004

Related U.S. Application Data

(60) Provisional application No. 60/448,877, filed on Feb. 24, 2003.

(51) Int. Cl.
*A63B 67/14* (2006.01)
*A63B 69/00* (2006.01)

(52) U.S. Cl. ..... 473/588; 473/446

(58) Field of Classification Search ..... 473/588, 473/589, 422, 471, 446, 451; D21/710, 713; 40/327

See application file for complete search history.

(56) References Cited

U.S. PATENT DOCUMENTS

| | | | | |
|---|---|---|---|---|
| 280,807 | A | 7/1883 | Farley | |
| 676,506 | A | 6/1901 | Knight et al. | |
| 2,925,273 | A | 2/1960 | Pratt | |
| 3,117,788 | A * | 1/1964 | Bnonanno et al. | 473/588 |
| 4,170,352 | A | 10/1979 | Vcala | |

(Continued)

FOREIGN PATENT DOCUMENTS

| | | |
|---|---|---|
| CA | 959872 | 12/1974 |
| CA | 1292756 | 12/1991 |
| CA | 2061075 | 9/1999 |

(Continued)

*Primary Examiner*—Raleigh W. Chiu
(74) *Attorney, Agent, or Firm*—Oyen Wiggs Green & Mutala, LLP

(57) ABSTRACT

This application relates to hockey pucks modified for training purposes and methods of using same. The pucks are intended to develop the visual acuity and hand-eye coordination of hockey players to improve game play. In one embodiment of the invention, each training puck is partially or entirely white (or some other light color) on its upper and lower flat surfaces, or on its circumferential side surface, or both. For example, the upper and lower surfaces may include a first relatively light portion around the periphery thereof and a relatively dark portion in a central region thereof. The relative size of the light and dark portions varies from puck to puck. In one embodiment the light portions are white and the dark portions are black. In use, players could begin by using a training puck with a relatively large dark portion. After they become accustomed to such a training puck, a puck with a smaller diameter dark portion could be substituted. This process would continue until pucks with very small dark portions were used. Finally, a completely light colored puck could be used. The smaller the size of the dark portions, the more difficult the puck will be to see on the ice or other light colored surface. Thus, by using the training pucks of the invention, players are required to increase their levels of concentration and visualization. When the players then revert to using regulation black pucks during hockey games, they are able to stick handle and pass the puck with enhanced ability and accuracy. The training pucks could sold or used separately or as part of a training kit comprising multiple pucks of varying appearance. Pucks adapted for training both skaters and goaltenders are described.

23 Claims, 3 Drawing Sheets

U.S. PATENT DOCUMENTS

| | | | | |
|---|---|---|---|---|
| D263,491 | S | 3/1982 | Surridge | |
| 4,991,838 | A | 2/1991 | Groves | |
| D323,369 | S | 1/1992 | De Masi, Jr. et al. | |
| 5,149,096 | A * | 9/1992 | Keating et al. | 473/588 |
| 5,184,820 | A | 2/1993 | Keating et al. | |
| 5,269,520 | A | 12/1993 | Vellines | |
| 5,284,343 | A | 2/1994 | Bigornia et al. | |
| 5,330,184 | A * | 7/1994 | Douglas | 473/588 |
| D367,902 | S | 3/1996 | Silk | |
| 5,518,237 | A | 5/1996 | Bellehumeur | |
| 5,607,152 | A | 3/1997 | Strassburger | |
| 5,711,725 | A | 1/1998 | Bengtson | |
| D396,255 | S | 7/1998 | Kotler | |
| D421,470 | S | 3/2000 | Takeoka | |
| 6,089,998 | A | 7/2000 | O'Neal et al. | |
| 2003/0216199 | A1* | 11/2003 | Summerfield | 473/588 |
| 2004/0235594 | A1* | 11/2004 | Pencer | 473/588 |

FOREIGN PATENT DOCUMENTS

| | | |
|---|---|---|
| WO | WO 93/20910 | 10/1993 |
| WO | WO9320910 | 10/1993 |

* cited by examiner

HOCKEY TRAINING PUCKS AND METHODS OF USING SAME

REFERENCE TO RELATED APPLICATION

This application claims the benefit of U.S. provisional patent application Ser. No. 60/448,877 filed 24 Feb. 2003.

TECHNICAL FIELD

This application relates to hockey pucks modified for training purposes and methods of using same.

BACKGROUND

Training aids for sports requiring hand-eye coordination are known in the prior art. U.S. Pat. No. 5,711,725, Bengtson, issued Jan. 27, 1998 relates to a practice baseball or softball having contrasting colors. Approximately one half of the outer surface of the ball is a dark color and the other half of the ball is white to make the ball more difficult to see than a standard ball. When used for practice, the ball requires players to concentrate intensely in order to hit or field the ball successfully because of the difficulty in seeing it clearly. During games when a light colored ball is used, it is much more visible and players are able to hit and field it better since they are used to practicing with a two colored practice ball.

U.S. Pat. No. 5,607,152, Strassburger, issued Mar. 4, 1997 similarly a baseball batter training aid which includes a plurality of baseballs each having different colored indicia on the outer surface. The baseball batter is required to recognize and identify the color of the indicia after the baseball is pitched, causing the batter to focus on the ball as it is delivered by the pitcher toward the hitting zone.

Other baseball training aids employing balls having surface markings are described in U.S. Pat. No. 2,925,273, Pratt, issued Feb. 16, 1960 and U.S. Pat. No. 4,991,838, Groves, issued Feb. 12, 1991.

U.S. Pat. No. 4,170,352, Vcala, issued Oct. 9, 1979, relates to a visual aid practice tennis ball. The ball has panels colored of contrasting colors for indicating the spin or rotation of the ball while in flight. This enables players and coaches to more easily discern the spin imparted to the ball to facilitate learning of delivery and receiving manoeuvers.

Surface markings are also know on other of types of sporting balls including croquet (U.S. Pat. No. 280,807 dated Jul. 10, 1883); golf (U.S. Pat. No. 676,506 dated Jun. 18,1901); soccer (U.S. Design Pat. Des. No. 263,491 dated Mar. 23, 1982); and beach volleyball (U.S. Design Pat. No. 421,470 dated Mar. 7, 2000).

Practice hockey pucks are known in the prior art for improving passing and shooting skills as well as goaltending skills. International application No. WO 93/20910, Bigornia et al., published Oct. 28, 1993 describes a hockey puck having a hollow body that may be filled with removable material to change the puck's weight for practice purposes. Additionally, a number of linear markings may be applied to the surfaces and edges of the puck to allow the user to monitor and analyze the spin of the puck. The optical guidelines can be used to compare and contrast different types of shots, such as wristshots, slapshots, backhands and snap-shots U.S. Pat. No. 5,184,820, Keating et al., issued Feb. 9, 1993 relates to a hockey puck which, in one embodiment, may include a ring or band of material of a color differing from the remainder of the puck about the periphery of the puck. The band may include a pigment added to it to give it a fluorescent color, such as orange or green. The band is intended to provide a higher visibility of the puck, for both the players and fans. Keating et al. contemplates that the primary color of the puck will be regulation black.

The prior art does not, however, teach the desirability of using hockey pucks having a light colored background (and which are therefore more difficult to see against a white ice surface). The need has therefore arisen for modified hockey pucks adapted for improving the hand-eye coordination and concentration of both skaters and goaltenders.

SUMMARY OF INVENTION

In accordance with the invention a kit comprising a plurality of hockey pucks for training purposes is provided. At least some of the pucks in the kit each comprise a first outer portion having a relatively light color and a second outer portion having a relatively dark color. The kit is configured such that the relative size of the first and second outer portions differs in at least some of said pucks.

In one embodiment the relatively dark second outer portion may be on a flat surface of at least some of the pucks, such as the circular upper surface or the circular lower surface, or both. In this embodiment the second outer portion may be circular. In another embodiment the second outer portion is on a curved side edge of at least some of said pucks. In this embodiment the second outer portion may be annular. The kit may also include one or more pucks having outer surfaces which are entirely said light color.

In one embodiment, the relatively light color is white and said relatively dark color is black. In another embodiment, the light color is light grey and said dark color is dark grey. In the latter embodiment the light grey or dark grey color may cover the entire outer surface of the puck.

The invention also relates to a hockey puck derived from the kit. Alternatively, the puck may be sold and used separate from the kit, the puck having a first outer portion having a relatively light color and a second outer portion having a relatively dark color as described above.

The invention also relates to method of training a hockey player comprising:

(a) providing a kit of hockey pucks as described above;
(b) selecting from the kit a subgroup of one or more of the pucks each having a relatively small first outer portion and a relatively large second outer portion;
(c) allowing the player to use the one or more pucks during one or more training sessions until the player becomes accustomed to using the one or more pucks;
(d) selecting from the kit a further subgroup of one or more pucks at least some of which have a larger first outer portion and a smaller second outer portion in comparison to the pucks previously selected; and
(e) repeating steps (c) and (d) such that the player becomes accustomed to training with pucks having progressively larger second outer portions and progressively smaller second outer portions.

The method may further include the step of selecting from the kit at least one puck having outer surfaces which are entirely said light color.

In one embodiment of the method goaltenders may be trained using pucks where the first and second portions are located on a curved side edge of said pucks and non-goaltenders (i.e. skaters) may be trained using pucks wherein said first and second portions are located on a flat upper surface or lower surface of said puck, or both of said upper and lower surfaces.

The method of the invention is improving the ability of a hockey player to visualize the location of a hockey puck during a hockey game by using pucks configured in accordance with the invention during training sessions.

BRIEF DESCRIPTION OF DRAWINGS

In drawings which illustrate embodiments of the invention, but which should not be construed as restricting the spirit or scope of the invention in any way.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Training in the sport of hockey requires individual and team practice to master numerous skills. Such skills include skating, passing, stick-handling, shooting, checking and positional play. In the case of goaltenders shot blocking techniques are also important. A core skill necessary to play effective hockey is the ability to visually perceive the puck and quickly identify its location and path of travel. The present invention is designed to help hockey players develop their visual perception and concentration skills during training sessions to improve game play.

Regulation hockey pucks are ordinarily black in color (apart from team logos or other printed indicia). In the Applicant's invention the training pucks are regulation size and weight, but they are partially or entirely white (or some other light color or non-black color). The pucks may be sold as a kit to allow coaches and players to select pucks which are progressively more difficult to see against a light colored background, such as an ice surface.

Figure 1A:
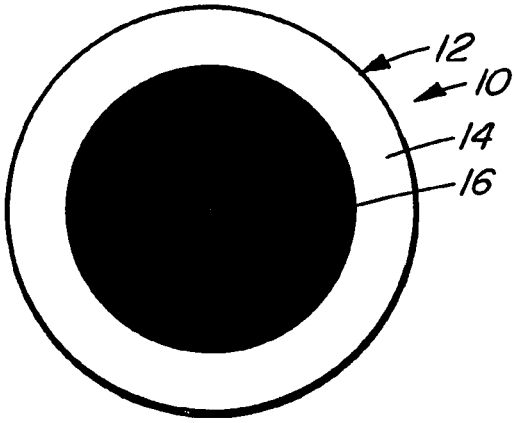
FIG. 1A-1E are a series of plan views of hockey pucks in accordance with the invention having a progressively smaller dark portion on their flat surfaces.
Figure 1B:
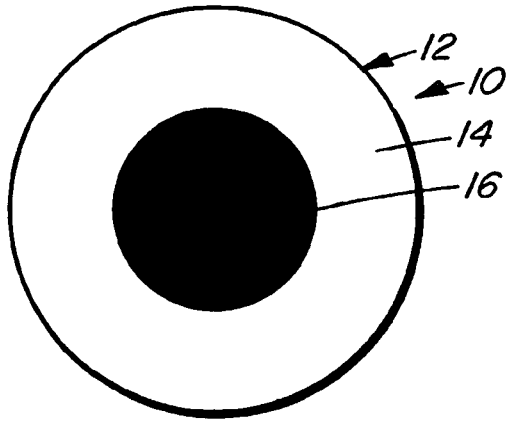
Figure 1C:
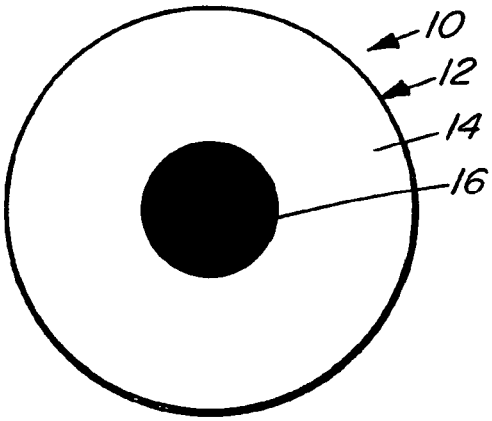
Figure 1D:
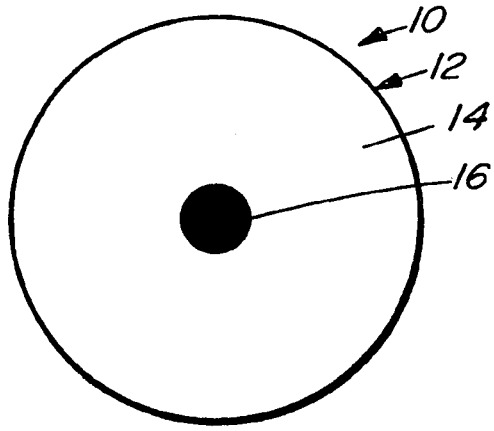
Figure 1E:
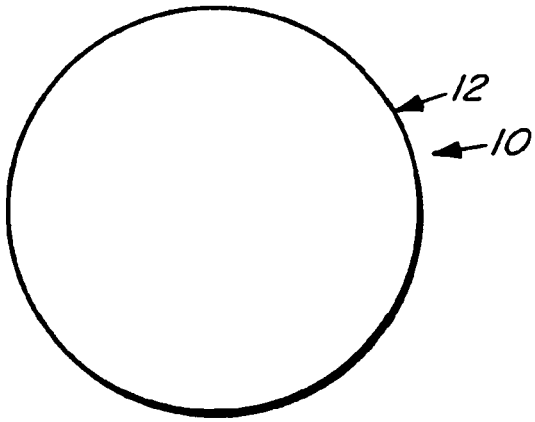

In one embodiment of the invention shown in FIGS. 1A-1E and 3 each training puck 10 is entirely or partially white or some other light color on its upper and lower flat circular surfaces 12. For example, the upper and lower surfaces 12 may include a first relatively light outer portion 14 around the periphery of surfaces 12 and a relatively dark outer portion 16 located in a central portion of surfaces 12. As used in this patent application, the word "outer" refers to an exterior surface of puck 10 visible to users. In the illustrated embodiment, dark portion 16 is circular in shape, although other shapes and patterns could be substituted. The relative size of light and dark portions 14, 16 varies as shown in FIGS. 1A-1E. For example, the diameter of the dark portion 16 is much smaller in the puck of FIG. 1D than in the puck of FIG. 1A. The diameter of dark portion 16 may range, for example, from 12 mm to 50 mm. In the puck of FIG. 1E the entire outer surface of the puck is light in color.

In the illustrated embodiment the dark color is black and the light color is white. However, other colors light and dark colors could be substituted without departing from the invention.

In use, players use training pucks 10 in practice sessions. For example, according to one training method, players could begin by using a puck 10 with a relatively large dark portion 16 (e.g. 50 mm in diameter). After they become accustomed to such a training puck 10, a puck 10 with a smaller diameter dark portion 16 could be substituted (e.g. 37 mm in diameter). This process would continue until pucks 10 with very small dark portions 16 (e.g. 25 mm or 12 mm in diameter) were used. Finally, a completely white puck 10 as shown in FIG. 1E could be used. As will be apparent to a person skilled in the art, the smaller the size of the dark portions 16, the more difficult the puck 10 will be to see on the white ice surface. Thus, by using the training pucks 10 of the Applicant's invention, players are required to increase their levels of concentration and visualization due to the decreased visibility of training pucks 10. When the players then revert to using regulation black pucks during hockey games they are able to stick handle and pass the puck with enhanced ability and accuracy.

Figure 2A:
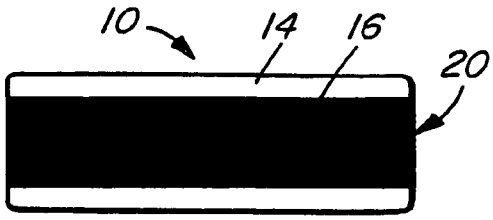
FIG. 2A-2F are a series of end elevational views of hockey pucks in accordance with the invention having a progressively smaller dark portion on their curved side surfaces.
Figure 2B:
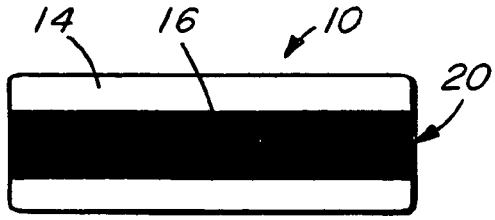
Figure 2C:
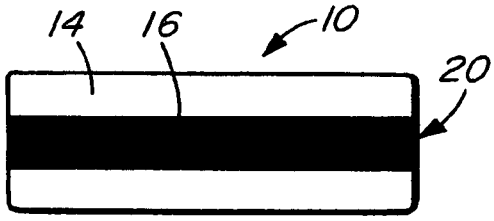
Figure 2D:
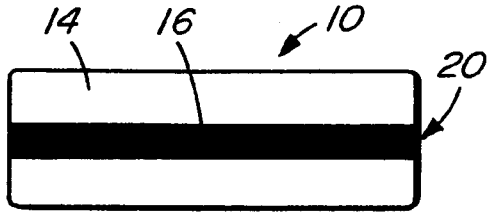
Figure 2E:
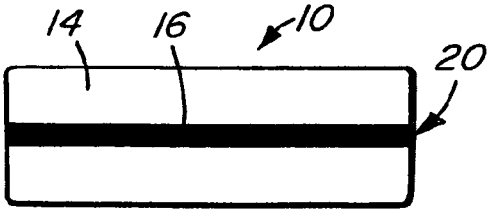
Figure 2F:
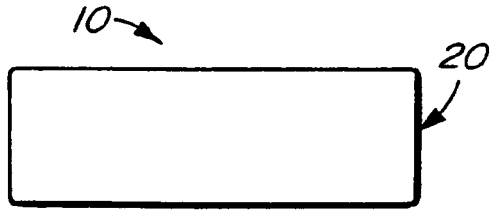
Figure 3:
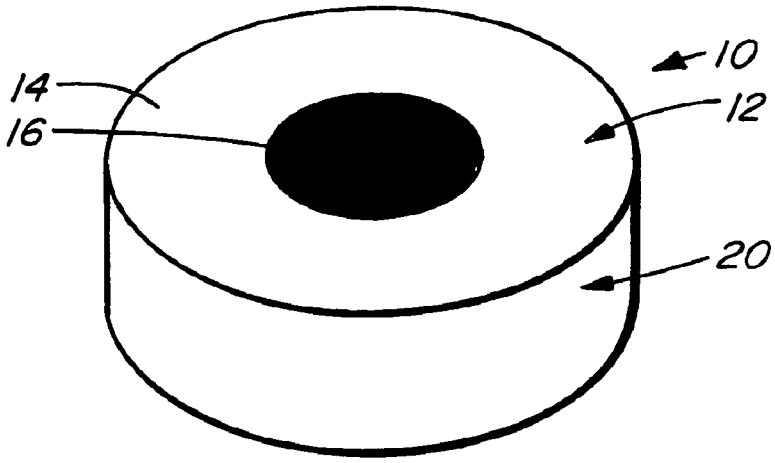
FIG. 3 is an isometric view of the puck of FIG. 1B.

Another embodiment of the invention is illustrated in FIGS. 2A-2F. In this embodiment the same principles may be employed except that the dark portions 16 of varying size are applied to the curved circumferential side surface 20 of puck 10 rather than flat top and bottom surfaces 20. In this embodiment, dark marking 16 may be in the shape of an annular stripe although other shapes or patterns could be substituted. The thickness of dark marking 16 may vary, for example, from about 15 mm to 3 mm. As in the first embodiment, an entirely white (or other light-colored) puck 1*p* could also be used to minimize visibility (FIG. 2F).

The training pucks 10 of FIGS. 2A-2F are primarily intended for in training goaltenders whereas the pucks 10 of FIGS. 1A-1E is primarily intended for use in training "skaters" (i.e. forwards or defencemen). In both cases, the ability to visually perceive a fast moving puck and react accordingly is critical to effective play.

The training pucks 10 described above could sold or used separately or as part of a training kit comprising multiple pucks 10 of varying appearance.

Figure 4A:
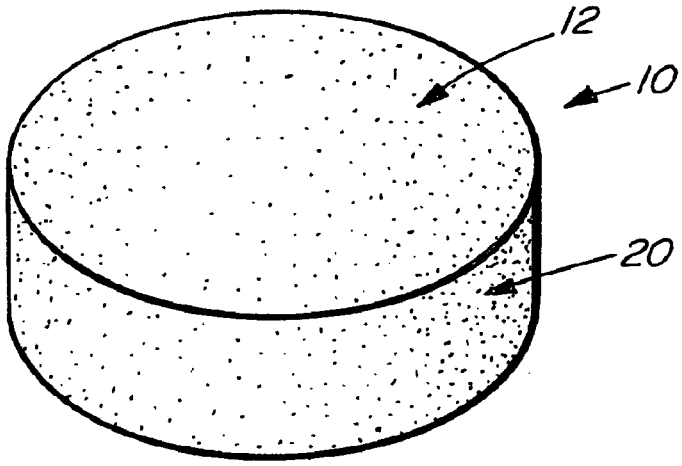
FIG. 4A is an isometric view of an alternative embodiment of the invention having an entirely light grey outer surface.
Figure 4B:
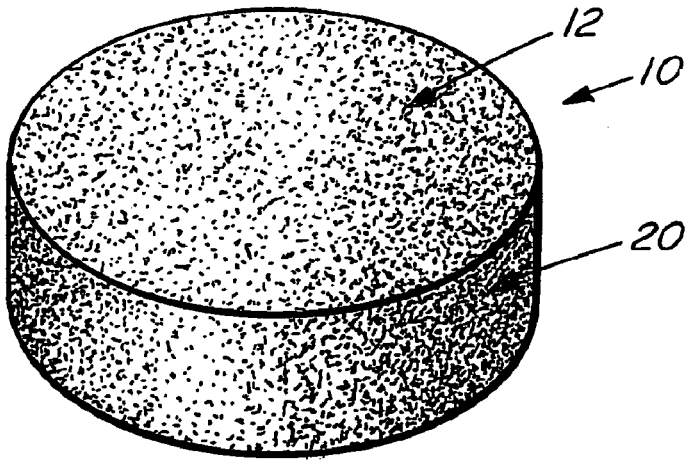
FIG. 4B is an isometric view of an alternative embodiment of the invention having an entirely dark grey outer surface.

In other embodiments of the invention, the training pucks 10 may be entirely light grey or dark grey in color for training purposes as shown in FIGS. 4A and 4B. Once again, such pucks are intended to be less visible on an ice surface than conventional regulation pucks and hence are capable of providing a training effect when used in practice sessions.

Pucks 10 may also potentially be used for training players on non-ice surfaces, particularly in the case of roller hockey or street hockey. As will be appreciated by a person skilled in the art, other colors could be selected depending on the color of the rink or other surface used for training purposes.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A kit comprising a plurality of hockey pucks for training purposes, wherein each of said pucks has substantially the same size, shape, and weight as a conventional regulation ice hockey puck, and wherein at least some of said pucks each comprise:

(a) a first outer portion having a relatively light color; and (b) a second outer portion having a relatively dark color, wherein the relative size of said first and second outer portions differs in at least some of said pucks and wherein, in each of said at least some of said pucks, said second outer portion is circular and has a diameter less than the diameter of said puck.

2. The kit as defined in claim 1, wherein said second outer portion is on a flat surface of at least some of said pucks.

3. The kit as defined in claim 2, wherein said flat surface is selected from the group consisting of a circular upper surface and a circular lower surface and wherein, in each of said at least some of said pucks, said second outer portion is applied only to said circular upper surface and said circular lower surface.

4. The kit as defined in claim 1, comprising at least one puck having outer surfaces which are entirely said light color.

5. A hockey puck derived from the kit of claim 4.

6. The kit as defined in claim 1, wherein said relatively light color is white and said relatively dark color is black.

7. The kit as defined in claim 1 wherein said light color is light grey and said dark color is dark grey.

8. A hockey puck derived from the kit of claim 1.

9. A kit comprising a plurality of hockey pucks for training purposes, wherein each of said pucks has substantially the same size, shape, and weight as a conventional regulation ice hockey puck, and wherein at least some of said pucks each comprise:

(a) a first outer portion having a relatively light color; and (b) a second outer portion having a relatively dark color, wherein the relative size of said first and second outer portions differs in at least some of said pucks and wherein said second outer portion is on a flat surface of at least some of said pucks, said flat surface being selected from the group consisting of a circular upper surface and a circular lower surface and wherein, in each of said at least some of said pucks, said second outer portion is applied only to said circular upper surface and said circular lower surface.

10. The kit as defined in claim 9, wherein said second outer portion is circular and has a diameter less than the diameter of said puck.

11. The kit as defined in claim 10, wherein second portion covers no more than two discrete regions of said puck.

12. A kit comprising a plurality of hockey pucks for training purposes, wherein each of said pucks has substantially the same size, shape, and weight as a conventional regulation ice hockey puck, and wherein at least some of said pucks each comprise:

(a) a first outer portion having a relatively light color; and (b) a second outer portion having a relatively dark color, wherein the relative size of said first and second outer portions differs in at least some of said pucks and wherein, in each of said at least some of said pucks, said second outer portion is applied only to a curved cylindrical surface of said pucks.

13. The kit as defined in claim 12, wherein said second outer portion is annular.

14. The kit as defined in claim 13, wherein said second outer portion has a width less than the width of said puck.

15. A hockey puck for training purposes having substantially the same size, shape, and weight as a conventional regulation ice hockey puck, said puck comprising:

(a) a first outer portion having a relatively light color; and (b) a second outer portion having a relatively dark color, wherein said relatively light color is white and said relatively dark color is black, and wherein said second outer portion is circular and has a diameter less than the diameter of said puck.

16. A hockey puck for training purposes having substantially the same size, shape, and weight as a conventional regulation ice hockey puck, said puck comprising:

(a) a first outer portion having a relatively light color; and (b) a second outer portion having a relatively dark color, wherein said second outer portion is on a flat surface of said puck selected from the group consisting of a circular upper surface and a circular lower surface of said puck, and wherein said second outer portion is circular and is applied only to said circular upper surface and said circular lower surface.

17. The puck as defined in claim 16, wherein said second outer portion has a diameter less than the diameter of said puck.

18. The puck as defined in claim 17, wherein said second outer portion covers no more than two discrete regions of said puck.

19. A hockey puck for training purposes having substantially the same size, shape, and weight as a conventional regulation ice hockey puck, said puck comprising:

(a) a first outer portion having a relatively light color; and (b) a second outer portion having a relatively dark color, wherein said relatively light color is white and said relatively dark color is black, and wherein said second outer portion is annular and is applied only to a curved cylindrical surface of said puck, wherein said second outer portion has a width less than the width of said puck.

20. A method of training a hockey player comprising:

(a) providing a kit of hockey pucks for training purposes, wherein at least some of said pucks each comprise:
  (i) a first outer portion having a relatively light color; and
  (ii) a second outer portion having a relatively dark color,
  wherein the relative size of said first and second outer portions differs in at least some of said pucks;
(b) selecting from said kit a subgroup of one or more of said pucks each having a relatively small first outer portion and a relatively large second outer portion;
(c) allowing said player to use said one or more pucks during one or more training sessions until said player becomes accustomed to using said one or more pucks;
(d) selecting from said kit a further subgroup of one or more pucks at least some of which have a larger first outer portion and a smaller second outer portion in comparison to the pucks previously selected;
(e) repeating steps (c) and (d) so that the player becomes accustomed to training with pucks having progressively larger second outer portions and progressively smaller second outer portions.

21. The method as defined in claim 20, further comprising selecting from said kit at least one puck having outer surfaces which are entirely said light color.

22. The method as defined in claim 20, wherein said player is a goaltender and wherein said first and second portions are located on a curved side edge of said pucks.

23. The method as defined in claim 20, wherein said player is a non-goaltender and wherein said first and second portions are located on a flat upper surface or lower surface of said puck or both of said upper and lower surfaces.

* * * * *